United States Patent [19]

Bergman et al.

[11] 4,149,441

[45] Apr. 17, 1979

[54] ELECTRICAL MUSICAL INSTRUMENT

[76] Inventors: Sune H. Bergman, Vommedalsvagen 42, 430 50 Kallered; Eric U. Seger, Saggatan 62, 414 67 Goteborg, both of Sweden

[21] Appl. No.: 641,189

[22] Filed: Dec. 16, 1975

[30] Foreign Application Priority Data

Dec. 17, 1974 [SE] Sweden ..... 7415845

[51] Int. Cl.[2] ..... G10F 1/00; G10H 3/06; G10H 1/02

[52] U.S. Cl. ..... 84/1.03; 84/1.17; 84/1.24; 84/DIG. 12; 84/DIG. 22

[58] Field of Search ..... 84/1.01, 1.03, DIG. 12, 84/DIG. 22, 1.17, 1.24

[56] References Cited

U.S. PATENT DOCUMENTS

| | | | |
|---|---|---|---|
| 3,099,700 | 7/1963 | Bergman | 84/1.19 |
| 3,718,748 | 2/1973 | Bunger | 84/1.24 |
| 3,935,783 | 2/1976 | Marchanran et al. | 84/1.13 |
| 4,019,417 | 4/1977 | Carlson | 84/1.17 |

*Primary Examiner*—Edith S. Jackmon

*Attorney, Agent, or Firm*—Burns, Doane, Swecker & Mathis

[57] ABSTRACT

A manually played electrical musical instrument of the electronic type in which simultaneously with selection and playing of a melody tone (note) a predetermined pattern of harmonies are also selected in such manner that at least five of the harmonies selected for the appertaining tone are mutually different. The instrument also includes generation of rhythm sound effects which permits programming of predetermined rhythm patterns defining the times of occurrence of predetermined rhythm sounds in a sequence of a predetermined number of beats, and generation of different bass tones according to a sequence of notes.

19 Claims, 14 Drawing Figures

Figure 1:
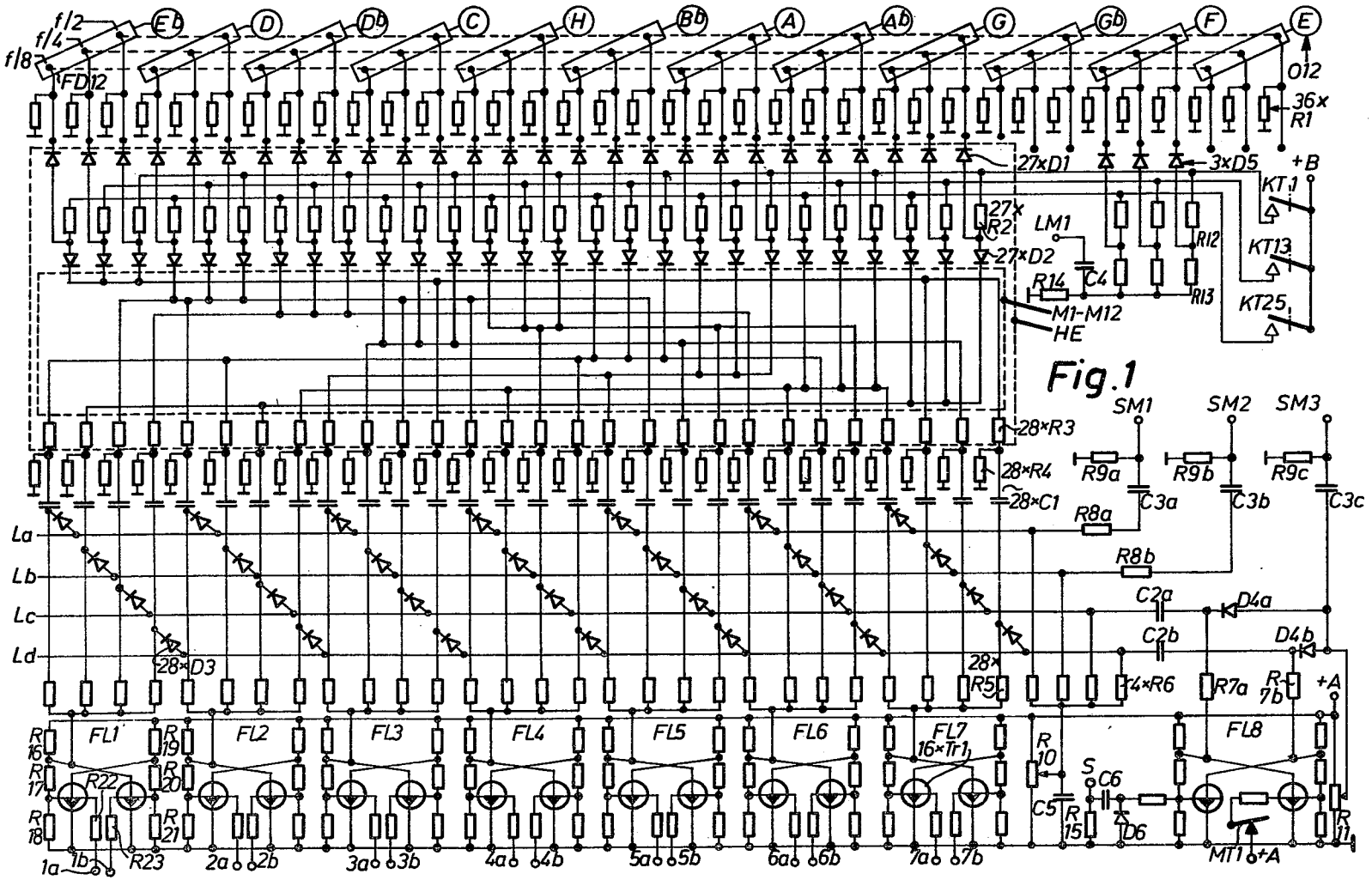

E
F
Gb
G
Ab
A
Bb
H
C
Db
D
Eb
f/2
f/4
f/8
FD12
012
36x
R1
+B
3xD5
KT1
KT13
KT25
R12
R13
C4
LM1
R14
M1-M12
HE
27xD1
27x
R2
27xD2
SM1
SM2
SM3
R9a
R9b
R9c
C3a
C3b
C3c
R8a
R8b
28xR3
28xR4
28xC1
C2a
C2b
D4a
D4b
R7a
R7b
14xR6
28x
R5
28xD3
La
Lb
Lc
Ld
+A
FL1
FL2
FL3
FL4
FL5
FL6
FL7
FL8
R16
R17
R18
R19
R20
R21
R22
R23
1a
1b
2a
2b
3a
3b
4a
4b
5a
5b
6a
6b
7a
7b
R10
C5
C6
D6
R15
R11
MT1
+A

BU
BM
BP
PR
NP
+A
BF1
BF2
BO
G1
G2
T19-
-T25
M21

+A
NS
D77
PG3
D81
G4
D78
PG4
D82
G3
R86
D73
D74
D69
D70
D61
D62
D57
D58
D53
D54
D49
D50
D45
D46
D41
D42
D37
D38
D33
D34
D29
D30
D25
D26
D21
D22
D17
D18
OK1
P9
D86
P8
D85
P7
D84
P6
D83
P12
P11
P5
D66
P4
P10
P9
P3
D65
D64
P2
D63
X
P1
X1
R92
R88
R89
R87
C36
C34
C35
N
T2
T1
R90
RZ
E1
T3
T4
T5
T6
T7
T8
T9
T10
T11
T12
T13
T14
T15
T16
T17
T18
C37
C38
R97
R98
R99
R91
R93
R94
R95
R96

PU
PN
+A
FL 15
D
D 118
D 119
D120
D121
D122
D123
R 140
R 141
R 142
R 143
R 144
R 145
R 146
R 147
R 148
R 149
R 150
R 151
R 152
R 153
R 154
R 155
C 55
C 56
T42
T43
T44
T45
T46
T47
D124
D125
D126
D127
Z6
Z7
RU
RN
Re 3
Re 4

MT14
MT15
P10
P9
P12
P11
R 171
R 172
R 173
R 174
R 175
R 176

NS
PK
PT
PD
PU
PN

+A
R 165
R 166
R 167
D130
D131
C60
C 61
C 62
Si 1
Su 1
F1 -F3

+A
R168
F1-F3
C 63
C64
L
R169
Su 2

76 x D132-D207
D207
MT13
MT2
MT2-MT13
D132
R177
R178
R179
C67
+A
G1
G2
G3
G4
G5
G6
C65
C66
Re 1
Re 2
FL9
FL10
FL11
FL12
FL13
FL14
R180
R181
R182
R183
R184
R185
R186
R187

ELECTRICAL MUSICAL INSTRUMENT

The present invention relates to electrical musical instruments comprising means for generating electrical signals corresponding to musical tones or sound effects and members operable by a player for collecting signals from said means for further treatment and/or transmitting to a sound reproducing device.

The means for generating electrical signals can in a manner known per se comprise a main oscillator, a so-called master oscillator, and a predetermined number of frequency dividers coupled thereto, but other devices for generating the electrical signals can be used. The electrical signals generated in said device need not have, and preferably do not, have the same frequency spectrum as the tone or sound effect which is eventually to be reproduced in a sound reproducing device, since the original signals can and preferably are intended to be modified or transformed in different manner with respect to its characteristic parameters. It may even be possible as original signals to use signals according to a simple code the solution of which being the tone and sound effects to be produced. The members for collecting or selecting signals can comprise, for instance, keys of a keyboard of any ordinary type.

It is usual in instruments of the aforementioned type to use members which are simple per se for transposition between different keys, said members being not described in a detailed manner in the present connection.

Known electrical musical instruments of the aforementioned type do, however, have various limitations from various aspects.

In a known instrument (see U.S. Pat. No. 3,099,700) there are circuit arrangements such that when, for instance, the keys of a keyboard are operated not only the tones corresponding to the operated keys which constitute the lead or melody part sound but also and simultaneously tones forming harmonies with the tones corresponding to the operated keys are generated. The harmony patterns obtainable with these known circuit arrangements are, however, relatively limited with respect to the number of possible, mutually different harmonies or chords within an octave. Another limitation exists with respect to the possibility of separately treating harmony tones intended to belong to separate sub-parts, and this means that in the known instrument it is not possible to assign a special tone character to each sub-part and thereby to obtain a musical effect corresponding to orchestral music.

It can furthermore be said that the known device because of the necessity to provide at least one special mechanical contact for each note in a harmony is, in practice, limited to the generation of harmonies containing only a few notes. The high number of mechanical contacts required in the known device is, on the whole, a drawback which does not only make the instrument expensive to buy and maintain but also affects its functional reliability.

As considered from another aspect it can be said that insofar as instruments according to the aforementioned type are arranged to generate an accompanying bass part by control by means of a pedal contact, instruments of the type hitherto known have had the drawback that they are limited as to the possibilities in a sequence of accompanying notes comprised of bass notes to let a great number of mutually different notes be included. Usually the number of notes included are limited to three viz. the fundamental note, the third and the fifth of the key in question which limitation contributes to the fact that the music performed is of a less varied and expressive character.

According to a further aspect the instruments of the aforementioned type when arranged as rhythmical instruments have the drawback that they do not permit the production of rhythms and rhythms effects with the richness in variety which is nowadays more often demanded and which is present in an ordinary orchestra. This depends inter alia of the use of automatic so-called rhythm apparatuses which usually are driven by an oscillator, i.e., an electronic motor which can be set to a limited number of different tempi and rhythms but which thereafter must be accurately followed by the player which, on one hand, is difficult and on the other hand leads to a music which is not felt as living.

A main object of the present invention is to avoid the abovementioned drawbacks of the electrical musical instruments known before and to provide an instrument which in its fully equipped state make it possible for a single player to produce music having the richness in variety which otherwise can be found only in music produced by an orchestra of an ordinary type.

Another object of the invention is to provide new solutions to various technical circuitry problems which can come up in connection with the building of a qualified electrical musical instrument.

Still another object of the invention is to provide new, simple and, as to the possible variations, rich harmony bass and rhythm systems which can be included singularly or in various combinations in an electrical musical instrument.

A musical instrument according to the invention of the aforementioned type is characterized, according to one aspect of the invention, of members adapted on the basis of signals simultaneously obtained from said means for generating electrical signals and for each key to provide a predetermined pattern of a number of harmonies for notes of the pertaining key in such a manner that at least five of the harmonies selected for the pertaining key are mutually different.

According to another aspect of the invention a musical instrument of the aforementioned type is characterized by means arranged at the execution of a first part of a musical score to simultaneously select and treat signals corresponding to at least two further parts in such a manner that the signals belonging to at least one such further part is treated via a separate channel apart from the signals belonging to other parts.

According to a further aspect of the invention a musical instrument of the aforementioned type is characterized by a circuit arrangement adapted at repeated operation of a contact operable by the player, preferably a pedal contact, to select from said means for generating electrical signals a sequence of notes of the scale belonging to each key, said sequence comprising the fundamental note, the fifth and the third and additionally at least one note of the chosen scale.

According to still another aspect of the invention a musical instrument of the aforementioned type in which the electrical signals correspond to rhythm effects and the members for selecting signals comprise at least one contact operable by the player, preferably a pedal contact, is characterized by a circuit arrangement adapted to allow insertion of a program of predetermined rhythm patterns, i.e. times of occurence and types of predetermined rhythm sounds in a sequence of a chosen number, preferably 16, parts of a bar (beats).

Further features and objects of the invention will be apparent from the following description with reference to the accompanying drawings which relate to embodiments which do not limit the scope of the invention.

Figure 2A:
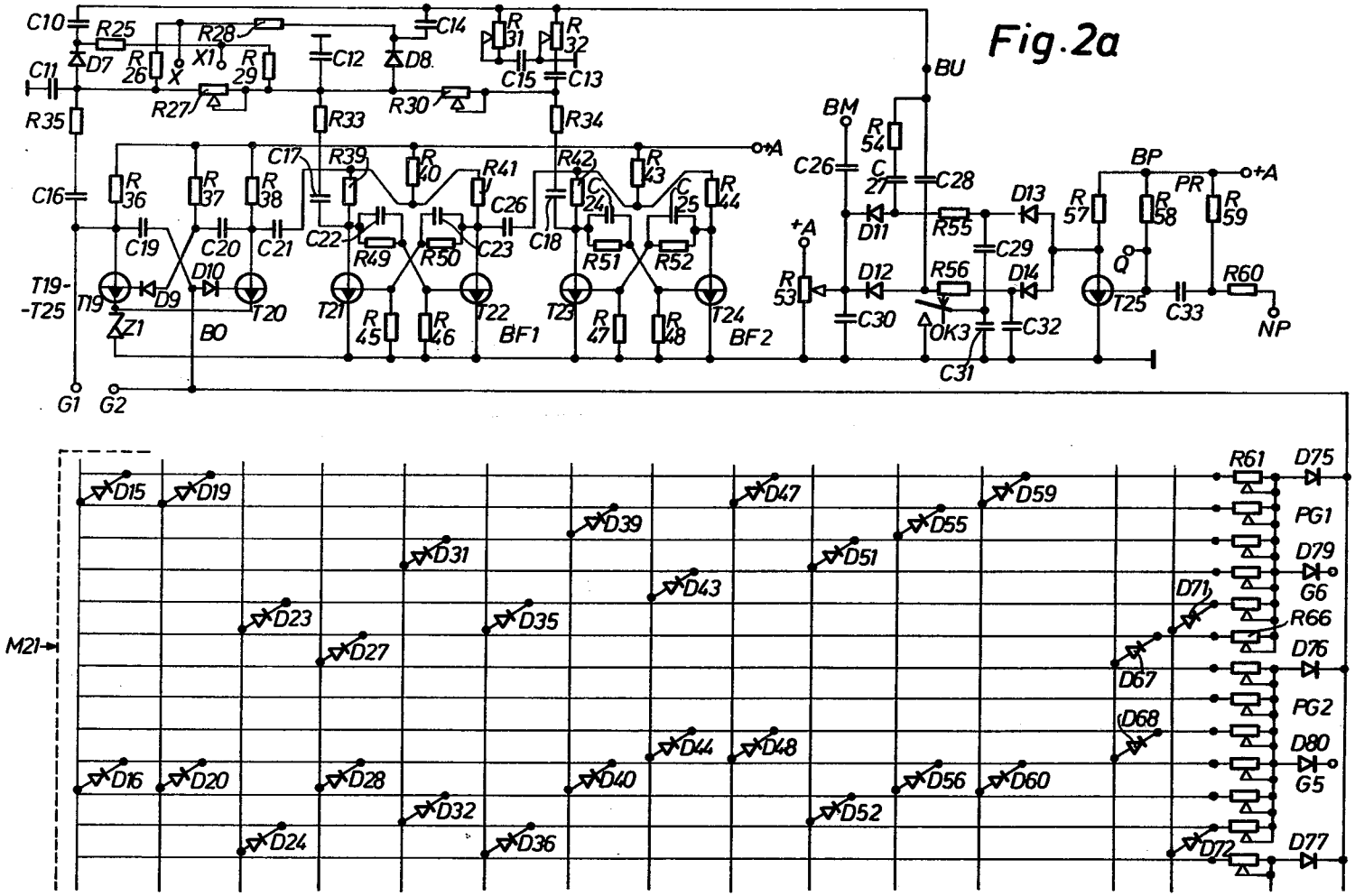
Figure 2B:
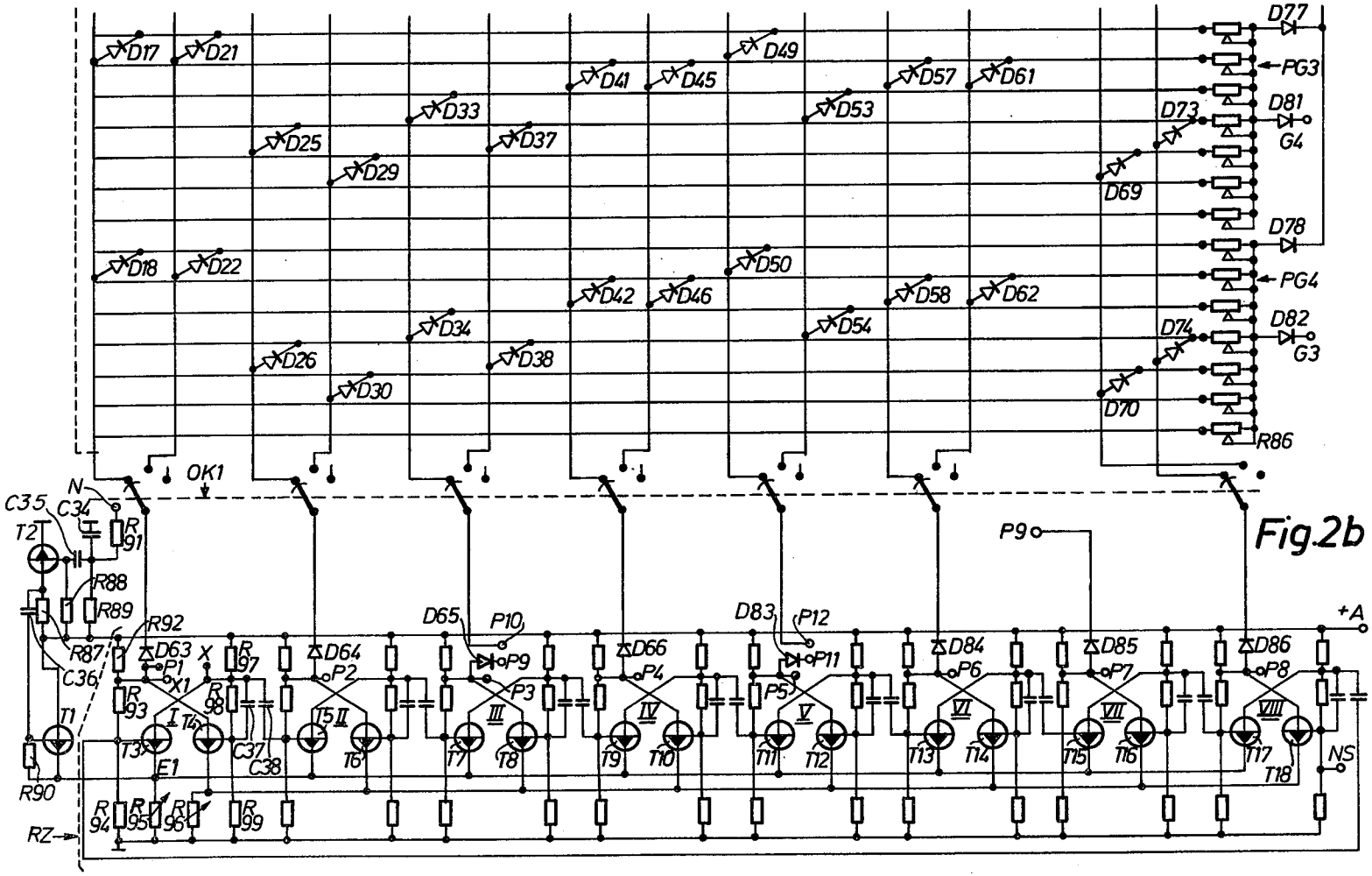
Figure 9:
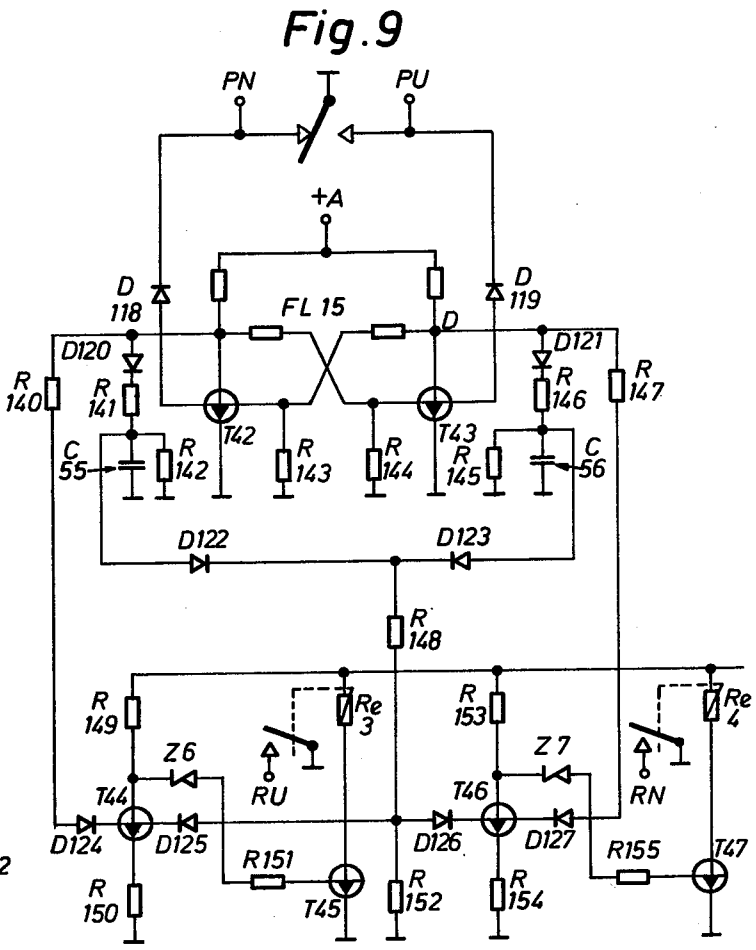
Figure 2C:
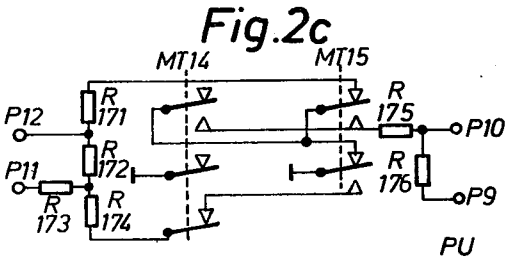
Figure 2D:
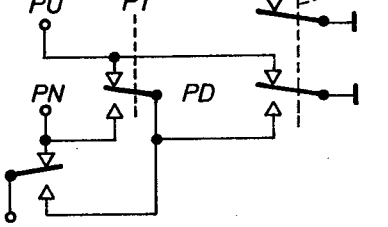
Figure 5:
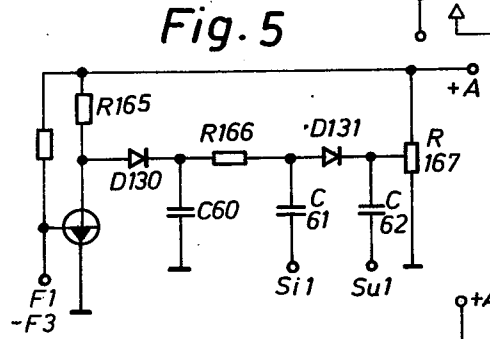
Figure 6:
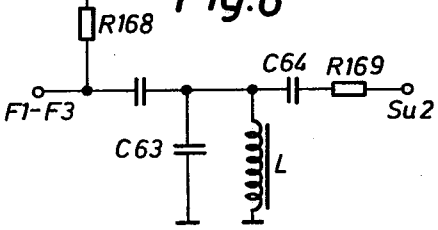
Figures 3A, 3B:
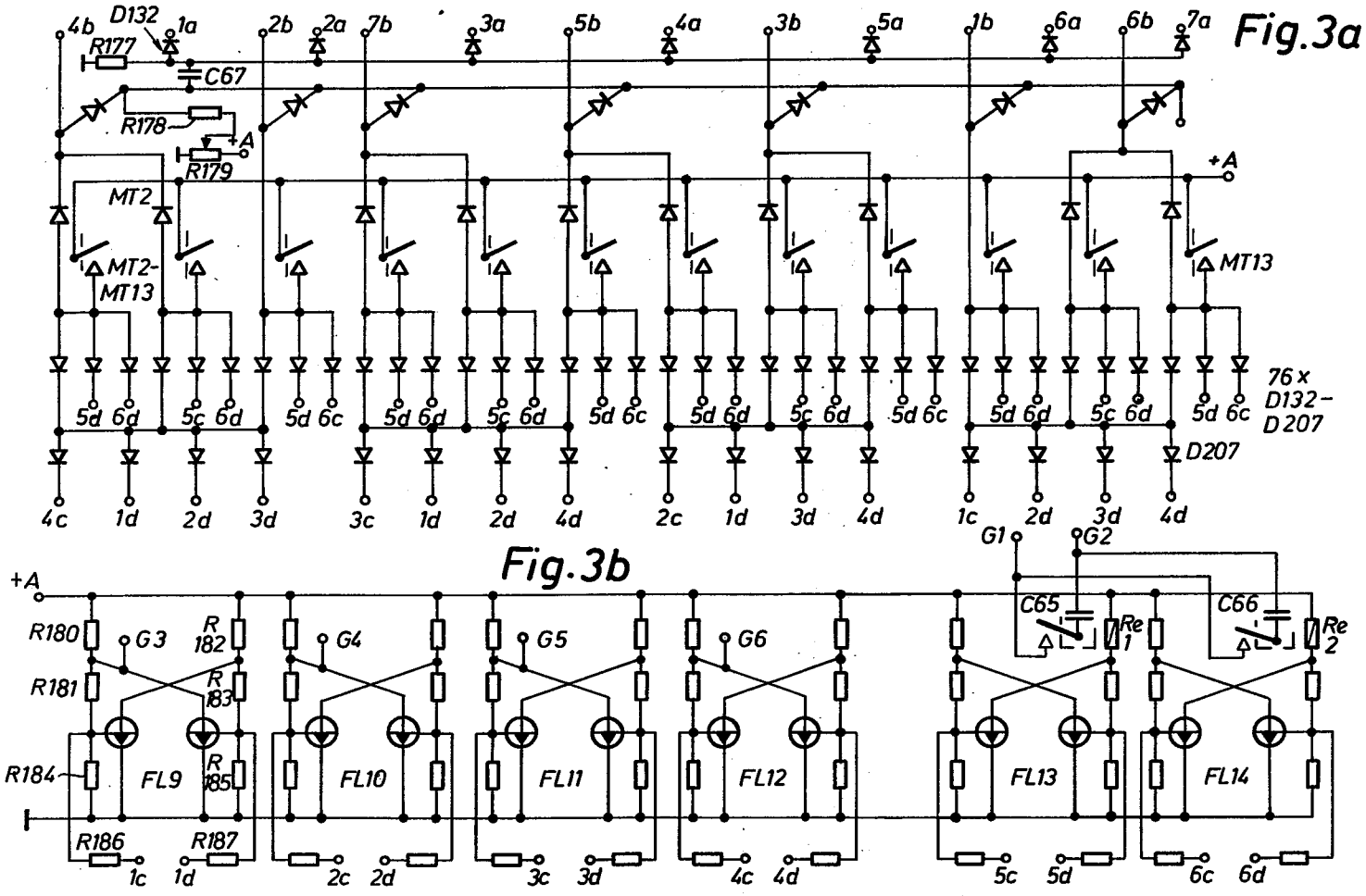
Figure 4:
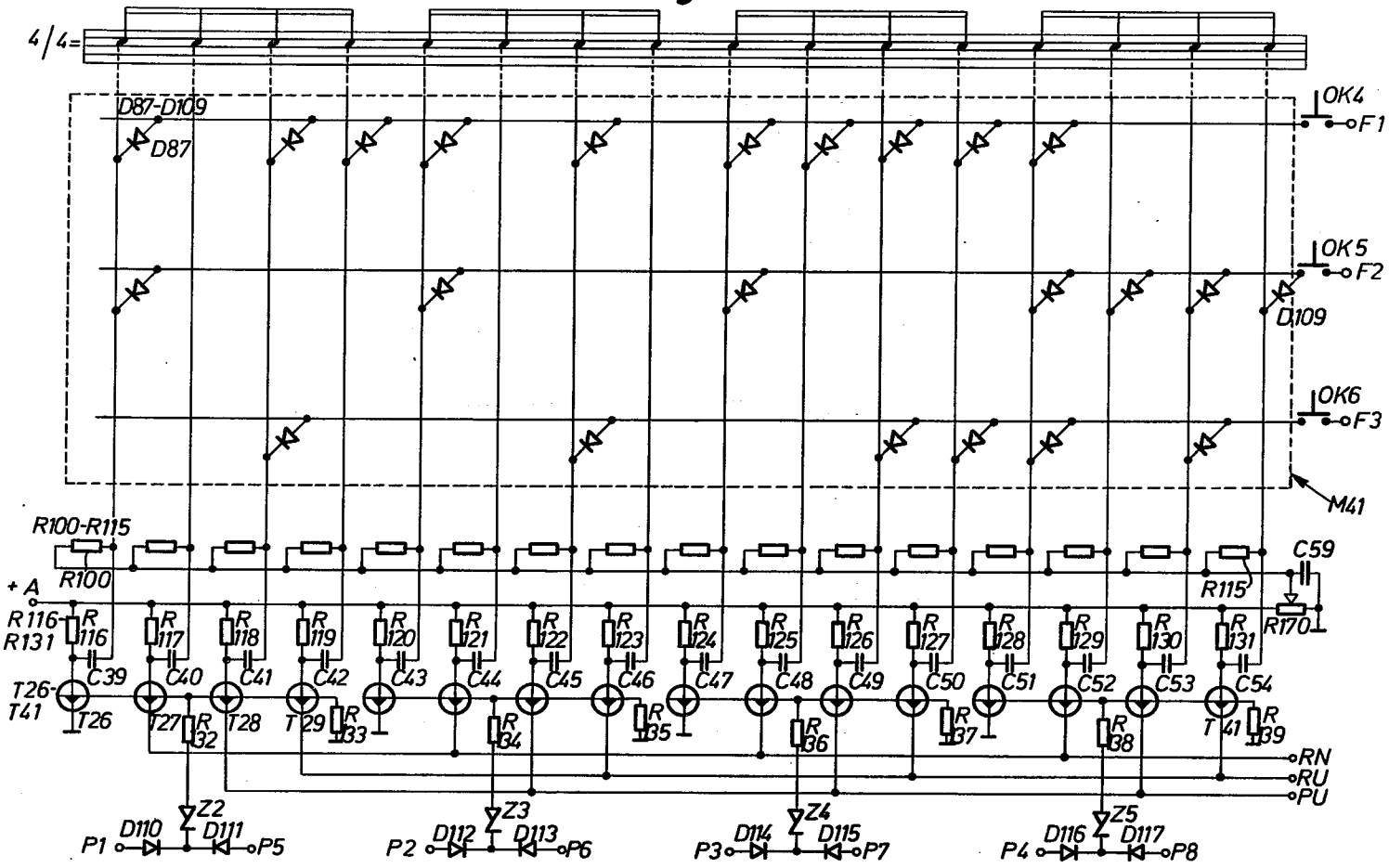
Figure 7:
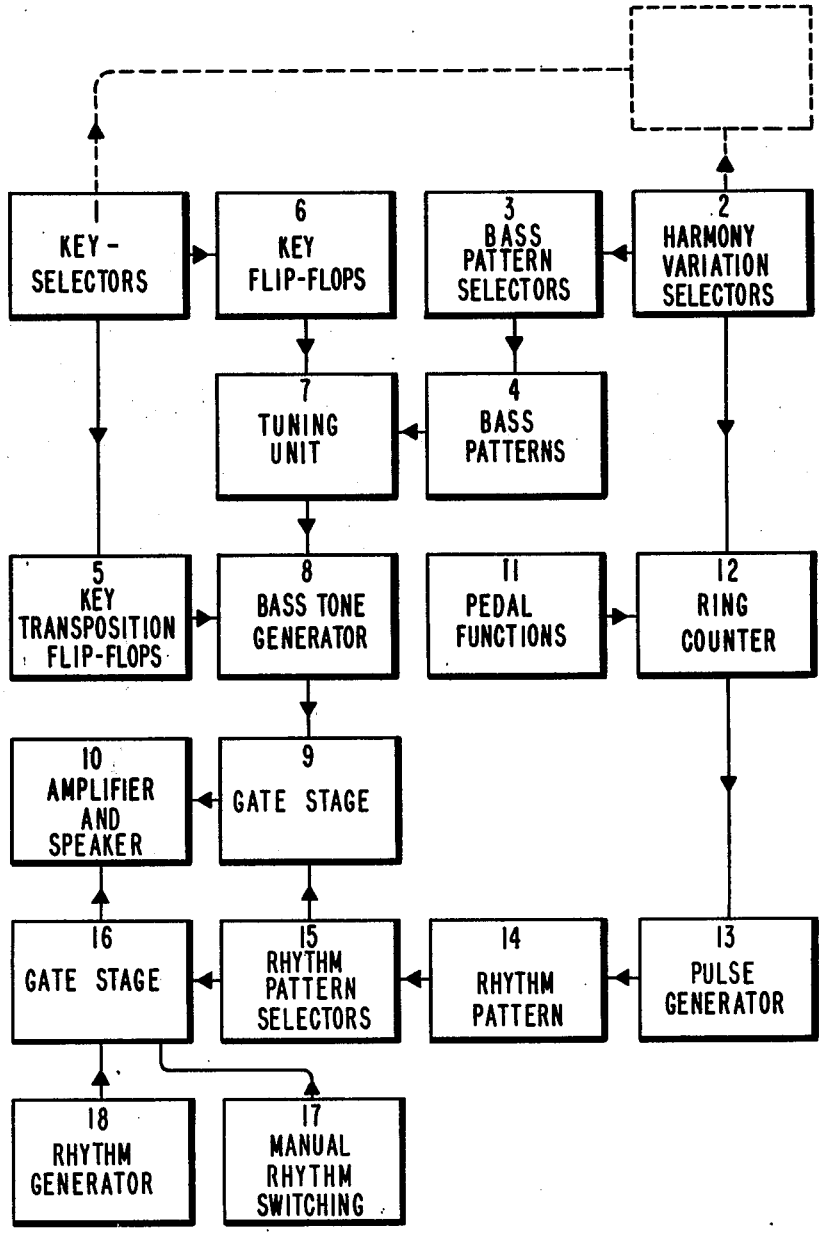
Figure 8:
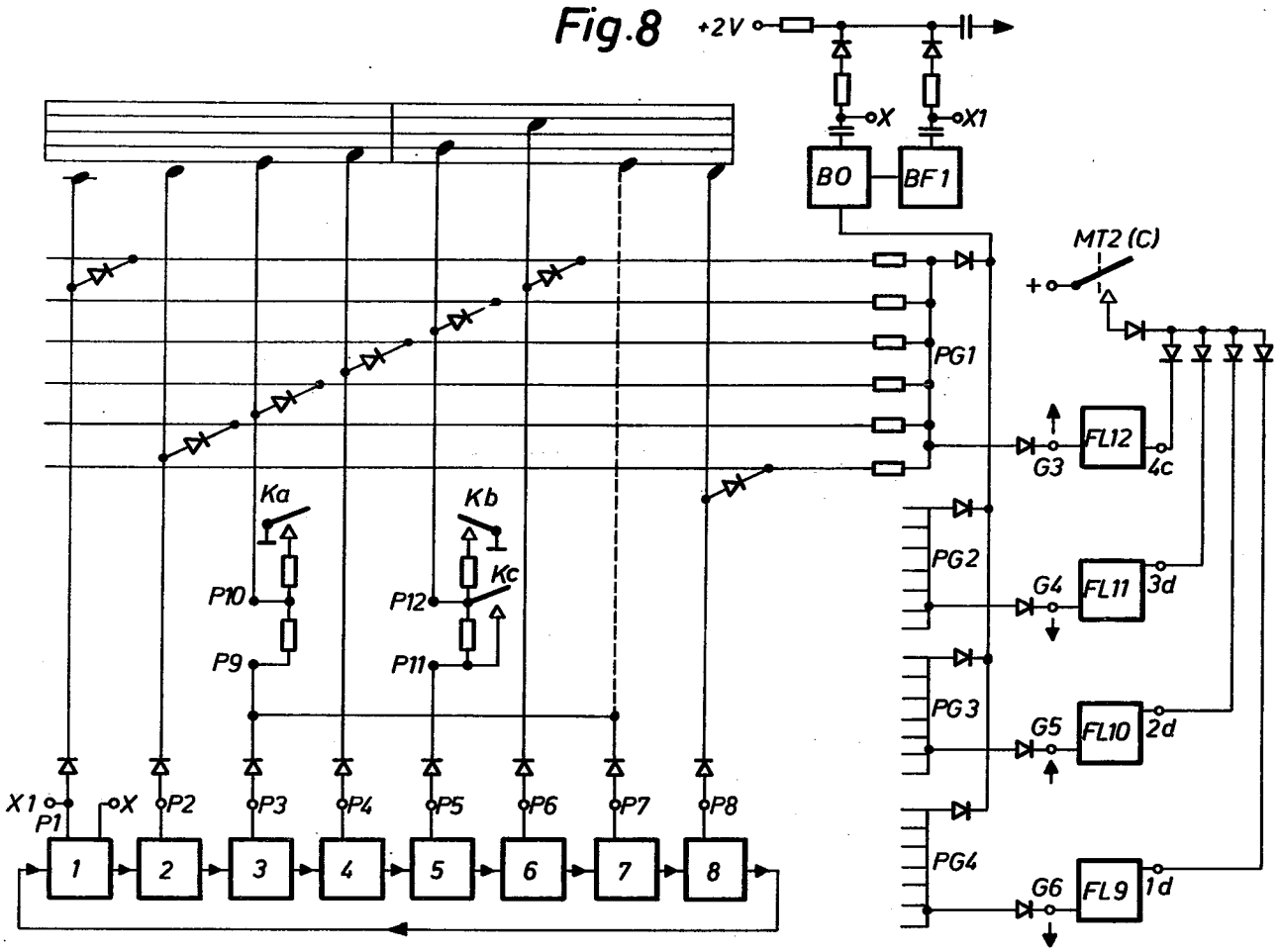
Figure 10:
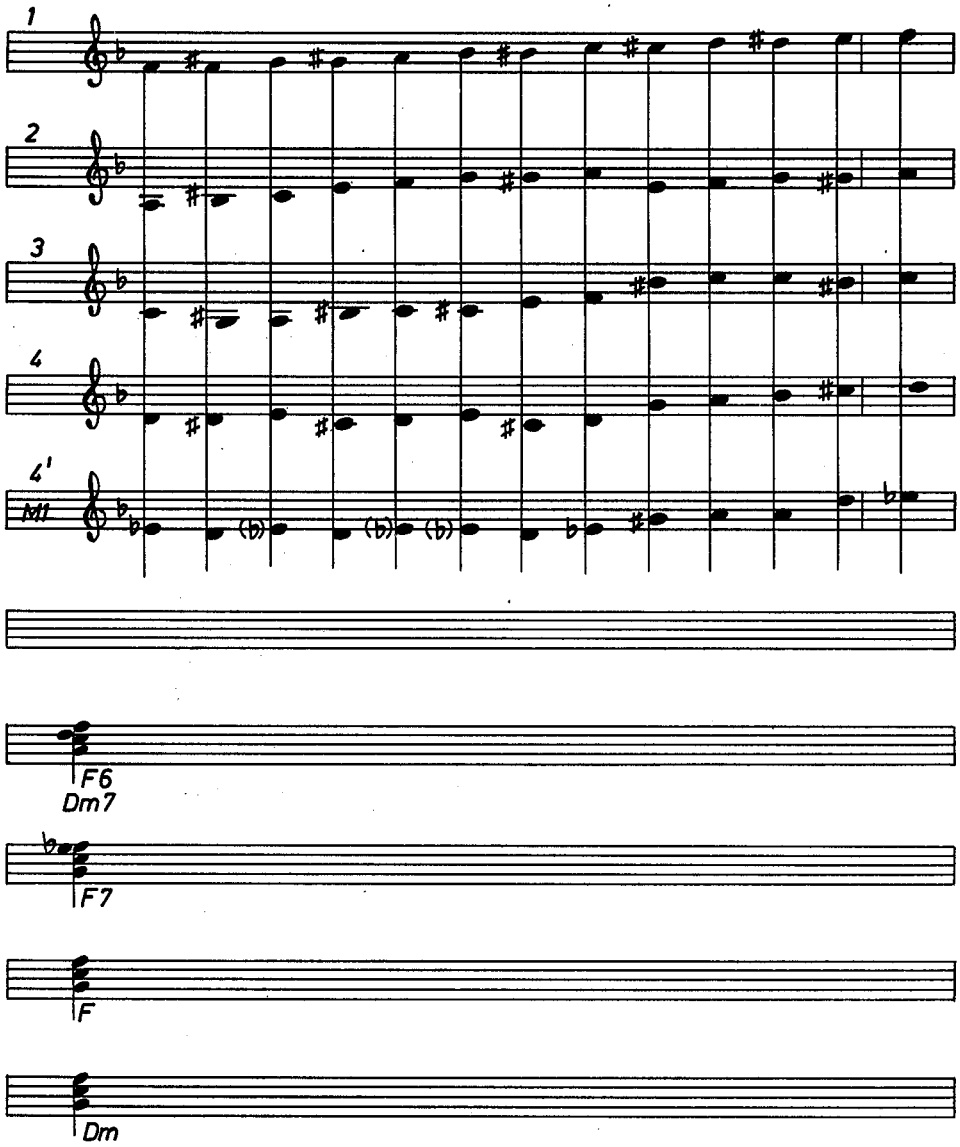

In the drawings, FIG. 1 is a circuit diagram of a part system, a so-called "harmony system" at the performance of a first "lead" part to simultaneously produce notes in separately treatable sub-parts, said notes forming harmonies together with the notes in said lead part. FIG. 1 also shows a number of signal-controlling flip-flop circuits. FIGS. 2*a* and 2 bare a circuit diagram of another part system, the so-called "bass system," with the purpose at repeated operation of at least one pedal contact of obtaining sequences of bass notes which sequences are usable as accompaniment in each pertaining key. FIGS. 2*c* and 2*d* show contact means for conrolling the system according to FIG. 2*a*. FIG. 3*a* shows the principle of a circuit diagram for a key selector comprised in the instrument. FIG. 3*b* shows a number of signal controlling flip-flop circuits beyond those shown in FIG. 1. FIGS. 4–6 show circuit diagrams for a further part system, the so-called rhythm system, which in each phase of a musical score makes it possible freely to choose tempo and rhythm FIG. 7 is a block diagram over various functions of an instrument according to the invention. FIG. 8 shows with reference to a note example circuits for obtaining and variation of a sequence of bass notes. FIG. 9 is a circuit diagram of a device for correcting an uneven rhythm operation in any phase during the performance of a musical work. FIG. 10 is a note example of a harmony pattern which can be applied in an instrument according to the invention.

The signal treatment systems which singularly or in an optional combination can be comprised in a musical instrument according to the invention shall first be shortly described as to their general features. The musical instrument according to the invention can suitably be coupled and programmed in its various systems so that it is suitable for the performance of popular music including evergreens, schlagers, songs, lighter jazz etc., but the systems according to the invention permit treatment of all types of music including music according to other tonal systems than those mostly used in occidental countries which are based on the twelve note scale, for instance the penta-tonal system etc. The instrument can be the shape of an electronic organ which, besides, can of course be arranged to be played in a conventional manner after shutting off the automatic systems for harmony, bass and rhythm patterns. The instrument can be provided with a keyboard comprising five octaves including 16', 8', 4', 2' and fifth, straight organ tune, percussion, sustain, switching table for various sound combinations, vibrato, various volume controls and volume pedal. In a stereo embodiment the melody part (together with the sub-parts, if desired) and the accompaniment may be brought to sound in difference loudspeakers.

In an orchestra score each harmony part is usually assigned to a particular instrument. The lead part, 1:st part, can for instance be a clarinet part (sometimes a song part) in certain popular music, the 2:nd part can be a saxophone part etc. An ordinary orchestra arrangement is written according to the conventional theory of harmony, the teaching of which has taken years for the composer to acquire. The harmony system according to the invention makes it possible to produce music which resembles orchestral music with all parts performed simultaneously without any need for the player to have knowledge of the theory of harmonies and orchestration. To provide the music it is sufficient for the player to use only one finger of each hand.

This has been made possible by the provision of harmony patterns which are based on fundamental portions of the theory of harmony and which are predetermined according to a program for each scale note of each key, it being possible by electronic couplings to separate the various parts from each other and treat them individually, so that one part can be different in sound character, volume etc., than another part. Finally, all parts are combined again so as to form the end product which can be reproduced by means of loud-speakers.

The lead part can be played by means of an ordinary key-board and the selection of keys can be made by means of a set of buttons comprising twelve buttons one for each key. (tonality)/Moreover one or more elongated bars pertaining to different harmony variations such as sept., dim., plus, non, can be provided extending for instance parallel to the keyboard. It should be pointed out that the instrument is so arranged. that when the lead part is played the sub-parts sound simultaneously. Although this way of playing is simple it is nevertheless possible to perform rapid multi-part playing passages which hitherto have not been possible to perform on a musical instrument of the traditional type, not even by the most qualified musician.

The manually operable means for the selection of keys and harmony variations can suitably be arranged in such manner by electronic couplings or mechanical arrangements so that a chosen key or harmony variation, respectively, is maintained as to its function from the moment at which the corresponding setting means was operated and until another setting means is operated. Thus, during this time interval the player has his hand free for the performance of other control functions without the playing having to be interrupted.

The above-mentioned setting means for the selection of key and harmony variations in the harmony system can also be used for controlling the bass system. The purpose of the bass system is to provide an accompaniment similar to that which is usually provided by means of a bass instrument, for instance a contrabass, an electrical bass etc. in most orchestras essentially for the purpose of supporting the harmony sounds of the orchestra.

The bass system is arranged to generate a sequence of notes for each key, said sequence being based on the conventional theory of harmony, and the bass patterns thus obtained are programmed into the electronics.

By this method a bass melody can be provided which fits to the lead part with sub-parts simultaneously performed by means of the harmony system. The bass system is suitably operated by means of a pedal device. By pressing a pedal the player selects a bass note which is brought to sound and die out in a similar manner as the tone of for instance a contrabass or electric bass. For each new pedal operation a new bass note in said sequence is obtained. Said pedal operations can be effected by means of a single pedal contact or alternately by means of two pedal contacts, for instance a heel and a toe contact according to the player's intentions.

For supporting the lead part and the sub-parts in popular music which mostly is written in 4/4-rhythm the bass part can be marked in each or every second fourth. However, the bass system permits the marking in many other ways for the performance of, for instance, Latin American music.

In the rhythm system according to the invention each 16th of a bar can be controlled and for this reason much varied rhythms can be obtained. The rhythm system can control various types of electronic rhythm signal generators, for instance for whisk accompaniment, hi-hat, maraccas, bongos, claves, rhythm guitars etc. The control can be effected by means of a special device but suitably by means of the same pedal device which is used for controlling the bass system according to the above. In this case the pedal device can provide a complete accompaniment ("comp-pedal"). Other rhythm effects which can be operated manually is, for instance, a bass drum, "rush-brake," cymbal. Different rhythm patterns can be brought into the program successively by the player by operating buttons in a special set of buttons at the instrument panel and the rhythm can thereafter be chosen and modified according to the fantasy and the taste of the player. Since the rhythm is always directly controllable by the player himself and is not dependent on any automatic, motor or oscillator driven so called rhythm apparatus as in certain previously known instruments the player is not limited to given tempi and predetermined rhythm patterns but can, as a beginner or as an experienced musician, easily and in every phase provide the accompaniment which according to his own taste is the best in the given musical connection.

The above-mentioned harmony, bass and rhythm patterns are intended to be used separately or together in an optional combination since a large part of the components can be common. In a musical sense they complete each other since the first mentioned system relates to a melodic/harmonic tone system and the other systems relate to an accompaniment thereto. A substantial advantage with the invention is that a beginner is spite of this inexperience can attain a good musical result already from the beginning which has hardly been possible with previously known and traditional musical instruments. Even virtuosi can obtain a result which a single person cannot possibly obtain when playing a traditional musical instrument and this because of natural technical limitations. The operation of the instrument according to the invention is effected by means of a few members and according to traditional fundamental rules. In a fully equipped state the instrument is intended as much as possible and by simple playing means to substitute what is usually meant by a full orchestra with its various functions such as, for instance, solo, melody, sub-parts, bass melody, rhythmic accompaniment etc. This without necessitating the use of automatic or self-going apparatuses having predetermine functions such as for instance tape recorders, automatic beat instruments (electronical or mechanical) etc.

The chosen harmony, bass and rhythm patterns can be of general nature. The pattern can, however, easily be modified in various respects according to the personal concept of the designer or the player. During playing of the instrument the lead melody, sub-parts, rhythm type, tempo, key etc. can be controlled all the time and treated individually and the player can also influence the result as to volume and the sound character of the instrument.

The orchestral result is attained in spite of the fact that the player need only use one finger of one hand for playing the melody, one finger of the other hand for controlling the harmony and one foot for performing the desired accompaniment by means of a special pedal for this purpose.

The circuit arrangement of the embodiments shown on the drawings comprise a great number of different electronical components which are conventional per se and whose connections in the circuits are so evident and clear from the drawings that they need not be more closely described in the present detailed description which, therefore, will be limited to describing substantially only the functions of the circuits and what is obtained by said circuits.

The harmony pattern system. The device according to FIG. 1 comprises twelve tone generators FD of usual type each consisting of a master oscillator and a number, for instance seven, of sequence dividers for each scale note within an octave of the instrument. A note is selected by pressing a key, for instance a key of a keyboard. The signals obtained from FD can be rich in overtones and can consist of for instance square or sawtooth signals. In FIG. 1 keyboard keys KT1 . . . KT13 . . . KT25 are marked by the contacts operated by such keys. The keyboard in question thus comprises three octaves, but the invention is of course not limited to this number.

Simultaneous keying of several channels is effected by a single contact function (contact closing) for each operation of a key KT1–KT25. This is possible thanks to the use of diode couplings thus saving considerably more expensive contact/conductor arrangements. Also the operational reliability is thereby increased. What has now been said is valid also for other means of operation which will be more fully described in the following, for instance for the selecting of keys, for modifying the harmony etc.

Now, as regards the leading (melody) key note it should be pointed out that this note can be registered in different manner, for instance for 32', 16', 8', 4', 2', fifth sustain and percussion: 4', 2', fifth. The scheme can be said to presuppose a simplified case (straight) simple tone signal. All permanent dc voltage levels are chosen such that the diodes in question open or close at the closing or opening by keys or other members of operation. A=+15 15V, B=+6V. At the operation of the key KT1 positive potential is transmitted via a resistance R12 to a diode D5 which is thus made conducting so that a tone signal from a frequency divider of ED corresponding to a certain tone, in the example the note F, is supplied to the terminal end LM1 via the resistance R13 and the capacitor C4 the side of which removed from the terminal being coupled to earth through the resistance R14. From the terminal LM1 the signal passes to a sound reproducing device directly or indirectly via shaping circuits which determine the tone character, and/or amplifiers. Said shaping circuits and amplifiers, are not shown in the drawing since they can be of conventional construction. The shaping circuits can for instance comprise a combination of filters adapted to cut a signal rich in overtones from the frequency divider FD so that the reproduced tone obtains the desired frequency spectrum and desired amplitudes of its overtones. The signal from LM1 is intended to be comprised in the "lead" part of melody part. This part will be accompanied by a number of sub-parts according to the following.

By the operation of KT1 positive potential is also carried via a number (9) of resistances R2 to a corresponding number of diodes D1 and D2 which thereby are made conducting so that tone signals from the frequency dividers of FD are supplied to a harmony pattern circuit positioned within the field M1-M12 which is marked by dotted lines.

This is coupled in accordance with certain harmonically conventionl and general principles. The circuit can, however, be varied in various manner and is thus not limited to the embodiment shown in the drawing. The instrument is intended to comprise twelve harmony pattern circuits M1-M12 one for each key within one octave. The number of harmony pattern circuits can be limited to twelve independently of how many octaves of the lead part the instrument comprises. Of these harmony pattern circuits at least five, suitably most of them and, if desired, all of them can be mutually different in such a manner that if the instrument is set (transposed) to a certain key and if one after the another of the keys KT1–KT12 within an octave of the scale is operated sub-parts forming harmonies together with the lead part is reproduced together and simultaneously with the leading part, at least five, suitably most of and, if desired, all these harmonies being, if desired, mutually different. The reproduced harmony for the key KT1 in the key setting according to FIG. 1, according to which the fundamental tone is F, is determined in a manner described more closely in the following of the harmony pattern circuit M1. The harmony for the next key KT2 corresponding to the lead tone $G^b$ in the scale is determined by the harmony pattern circuit M2 (not shown) for this key etc. Thus, each of the twelve harmony pattern circuits determines only one harmony in the succession of harmonies (the harmony pattern) which is assigned to the twelve notes in the scale of notes of the key to which the instrument is set at the time in question. In the succession of harmony pattern circuits M1, M2 etc. each circuit can, but need not, contain the same series of a predetermined number (27 in the shown embodiment) of input-output connections as all the other eleven harmony pattern circuits but with the various input-output connections being shifted one step to the right (or to the left) in each harmony pattern circuit in said succession and with the last input-output connection in one circuit becoming the first input-output connection in the next circuit etc. (cyclical permutation). However, each harmony pattern circuit in said series of twelve circuits can be individually designed in order to provide extremely varied harmony patterns if desired.

In the harmony pattern circuit M1 the tone signals are distributed and pass via R3 and C1. As appears from the scheme each key selects from the tone generator FD "its proper" tone signal (for the lead part) but also nine further tone signals (sub-parts) in the same manner. It is among the latter that the tone signals for four different parts are selected by the harmony pattern according to the shown system. These parts can suitably be for instance the third, the fifth, the sixth and the septima, if the lead tone is the fundamental. In relation to the fundamental, i.e. the note F in the example, the sub-parts are represented frequency-wise downwards of the succession of notes $E^b$, D, $D^b$, C, H, $B^b$, A, $A^b$ and G. In the same manner the lead not E will receive by transposition the notes D to $G^b$, $E^b$ from $D^b$ to F etc. The number of sub-parts need not be limited to nine but can be higher or lower and be of higher or lower frequencies. The scheme shows that this group of nine is thereafter distributed via the capacitors C1 to seven part units each containing four sub-parts. The part units are in operation only one at a time and which of the part units is in operation is determined by the setting of flip-flop circuits FL1–FL7 shown at the bottom of FIG. 1, the number of said flip-flop circuits corresponding to the number of part units and the functions of which appears from the following.

Considering the functions of the four components C1, D3 and R5 of for instance the first, left part unit it appears that the four R5 -resistances of the group are connected to the one collector of the flip-flop circuit FL1. The flip-flop circuits are so connected that when one of the flip-flop circuits is in b-position all the other are always in the a-position depending of the diode arrangement at the operation buttons MT2–MT13 according to FIG. 3*a* and the operation key MT1 (FIG. 1). If the flip-flop circuit FL1 is brought into the b-position to one transistor is conductive which results in that the four diodes D3 in the first left part unit is likewise conductive while the other diodes D3 (24 in number) are non-conducting depending of the function of R6, R10 and C5 which determine the fixed dc-potential level of the four horizontal conductors La-Lb. From this it appears that in the example according to FIG. 1 the tone signal $B^b$, G, D, $D^b$, and only these signals are transmitted to La, Lb, Lc and Ld. The signals of La and Lb pass via R8a and R8b, respectively, and C3a and C3b, respectively, directly to the terminals SM1 and SM2 and form sub-parts, the 2nd and 3rd parts, respectively, thus in the present example, $B^b$ and G. One of the signals on Lc and Ld are stopped depending of the position of the flip-flop circuit FL8. This circuit is connected to the points of connection between C2a, C2b and C4a and C4b, respectively, via R7a, R7b, respectively. If the key MT1 is operated the left hand transistor of FL8 becomes conducting which results in that one diode D4b becomes conducting and the signal passes further to SM3 via C3c and forms the 4th part $D^b$. If the flip-flop circuit is brought to change over by means of MT1 the other diode D4a will instead become conducting so that SM3 receives the tone D. The key MT1 has for its task to change from major/minor-harmonic to septima/nonaharmonic accords. If the output terminal SM3 is blocked there remains SM1 and SM2 which together with the lead tone form the three-tone chord for playing in major key. A similar function is performed if SM2 is blocked at which occasion three-tone chords for playing in minor keys are formed. The blocking of said output terminals can simply be effected by means of interruptors which are not shown in the drawings which interruptors can be operable by means of a "major"-bar and a "minor"-bar, respectively, which are not shown either but can consist of elongated members arranged along row of key selector.

From the output terminals SM1, SM2 and SM3 the respective signals can in an analogous manner as the signal from the output LM1 be carried via shaping circuits and amplifiers to a sound reproducing device. The shaping circuits can in this case be adapted to give individual sound character to each terminal's signals so that the performed harmonies obtain orchestra character (each different instrument assigned to one part). Furthermore, in order to obtain stereo effect it is possible to let for instance the lead part from LM1 be reproduced by one loud-speaker and the sub-parts from SM1-SM3 to be reproduced in another loud-speaker.

The note example shown in FIG. 10 indictes the harmonies, i.e. the harmony pattern which is obtained in one embodiment in which the instrument is set to F and when playing the chromatic scale beginning from the note F. The upper system indicates the notes of the leading part, the next lower system indicates the 2nd part etc. The 4th system from above indicates the notes of the 4th part if the contact MT1 is not closed and the 5th system indicates the notes when MT1 is closed.

The note example of FIG. 10 only relates to a selected application among many possible applications within a large field of variation. It appears from the scheme that only seven (of properly twelve possible) harmony groups have been used. This is so because notes belonging to two keys can be said to be included in each group. This is possible especially if these two keys have a very remote harmonical relationship. Thus, it is possible to place for instance the E and F keys in the same function. Key E formations are often used as harmony variations or harmony transitions in the key F so that it can be practical for a melody carrying lead part in F to obtain a harmony pattern formed by subparts in which pattern such key E formations are included and this is also in agreement with usual harmonizing practice. Besides, it can be said to be desirable from the point of view of cost saving to assemble several key functions in the same circuit. Also other harmony formations can be present in each key which appears from the note example of FIG. 10. It should be pointed out that the harmony pattern circuit, the number of sub-parts, the distribution thereof, the number of input- and outputs tone signals etc. need not be limited to what is shown in the drawings.

The manner in which the selection of a desired key is effected in the harmony system shown in FIG. 1 will appear in connection with the following description of the bass pattern system and the rhythm pattern system according to the invention with reference to the FIGS. 2*a* -9.

FIG. 7 shows a block diagram of te bass and rhythm pattern systems with certain functional relationships between these systems and the harmony pattern system being also indicated. Before describing the bass and rhythm pattern systems it should be pointed out that each flip-flop circuit in the circuit according to FIG. 1 (FL1–FL8) as well as in the circuit according to FIG. 3*b* (FL9–FL14) are arranged to provide a holding function which is necessary in order to facilitate rapid changes in the selection of keys and thus for avoiding interruptions in the progression of harmonies and the bass melody. Moreover, a good time margin between the manual operations of various buttons and bars more closely described in the following is obtained.

Reference numeral 1 3 FIG. 7 designates key selectors which are more clearly shown in FIG. 3*a* where twelve key selectors are represented by their respective contacts MT2–MT13. These contacts can, for instance, be operable by corresponding buttons arranged in one or more rows at the instrument panel in such a manner that they can easily be actuated by the left hand of the player at the same time as the player performs the lead part with sub-parts with his right hand on a keyboard for this purpose.

The contacts MT2–MT13 cooperate according to FIG. 3*a* with diode circuits D132–D207.

In FIG. 7 the reference numeral 2 designates harmony variation selectors. In a large part of the musical repertoire certain harmony or chord variations are used in addition to the basic harmonies, for instance harmonies having diminished third, diminished fifth, augmented fifth etc. corresponding to the conventional designations minor, dim,+ etc. In order to facilitate such variations the instrument is provided with operation keys MT14 and MT15, FIG. 2*c*, which can be used in addition to said key selectors. The output connections Pg--P12 of the device according to FIG. 2*c* are shown at the lower part of the circuit according to FIG. 2*b*. It is a general feature of all drawings that contacts having identical designations are intended to be directly connected to each other. Since some music does not presuppose deviations from the fundamental harmonies which are determined by the harmony pattern systems, harmony variation selectors need not always be present.

In FIG. 7 the reference numerals 3 and 4 designate bass pattern selectors and bass patterns. The bass patterns can be of two types, one which can be disposed "freely" without taking consideration to certain predetermined positions in the sub-division of the bars such as the positions for the third and the fifth and one which has predetermined positions for these chords. In the following the design of such a bass pattern used in connection with harmony variation selectors shall be described. If the latter is not used the harmonies are determined by the key selectors which provide only fundamental harmony bass patterns, for instance in major keys.

The bass pattern determining unit M21 in FIG. 2*a* comprises a number of "horizontal" conductors connected to a number of "vertical" conductors by means of diodes D15–D74 in accordance with predetermined patterns which have been chosen beforehand in order to provide bass melody phrases of a general character.

It should be mentioned that the bass pattern according to the embodiment provides a fundamental harmony in major keys. Bass patterns in minor key presuppose the use of harmony variation selectors by which the harmonies can be changed (modified) which is effected by means of manually operable contacts Ka, Kb and Kc according to the scheme in FIG. 8, which contacts are adapted to connect and disconnect resistances in the manner shown in FIG. 8 which results in diminishing or augmentation of the output potential at the output terminals P3, P7 (third) and P5 (fifth), respectively, of the ring-counter. This is made possible since it has been determined in advance that each bass melody phrase will have the third and the fifth, respectively, of the fundamental chord falling in the third/seventh and fifth part, respectively of a phrase comprising two bars in a 4/4 rhythm. In FIG. 2*b* OK1 designates a bass pattern selector which consists of multiple switches for selection as desired among various bass patterns, i.e. various sequences of bass notes. The switch is a 7-pool multiswitch. It is connected to output terminals P1–P8 of a so called ring-counter which is shown at the bottom of FIG. 2*b* and consists of a cascade circuit of a number of multivibrator circuits. The ring-counter is based on known musical bar division principles, for instance two bars in 4/4-rhythm, 4 bars in 2/4-rhythm etc.

The reference numeral 5 in FIG. 7 designates flip-flop circuits for transposition of keys. These circuits are designated by FL13 and FL14 in FIG. 3*b*. One collector resistance in each circuit has been substituted by a relay Re1 and Re2. Each of these relays control a contact function (closing) the purpose of which being to connect the capacitors C65 or C66 in parallel with the partly frequency determining capacitor C19 in the base oscillator BO according to FIG. 2*a*. These capacitors determine the choice of key among three adjacent keys. If none of the capacitors C65 and C66 is connected into circuit it is supposed that the key is determined to, for instance, C when the base resistances R61, R66 in PG1 in FIG. 2*a* are set in a manner which will be more closely described hereinbelow in connection with the detailed description of the tuning unit 7 in FIG. 7. If C65 is connected in parallel to C19 the key will be H, thus a transposition by a half degree which is also effected for all tone frequencies within the same key, but with maintained tuning positions for R61–R66. When C66 is connected in parallel the key $B^b$ is obtained which is a further half degree from H, i.e. a transposition by a full degree from the starting position C key.

The reference numeral 6 in FIG. 7 designates flip-flop circuits for keys. These circuits are constituted in FIG. 3*b* by flip-flop circuits FL9–FL12 each connected to one key group PG1–PG4, FIG. 2*a*. In accordance what has been described above three different, adjacent tonal or key settings are obtained by trans-position. This is true for each of the key groups PG1–PG4. In total this means twelve keys or tonalities and in addition thereto the above-mentioned harmony variations.

The block designation 7 in FIG. 7 relates to a tuning unit for the bass notes. This unit comprises, see FIGS. 2*a* and 2*b*, trim potentiometers R61–R86 arranged in four groups each having a diode output D75–D78 to the base of one transistor of the base oscillator $B^O$, and each with one additional diode D79–D82 connected to the respective flip-flop circuit FL9, FL12, FIG. 3*b*, via the outputs G3–G6. The trim potentiometers allow tuning of the tone frequencies which are used in the musically determined bass tone pattern. Each group of trim potentiometers allow tuning of all bass tones of the bass patterns belonging to the group. If it is supposed that the potentiometer group PG1 is used for the keys C, H and $B^b$ R61–R66 can be arranged for tuning the bass tones C, A, G, F, E and D respectively, which tones can occur in bass patterns of various appearance in the key or tonality C. The same potentiometer group can, however, also be used for tuning in the keys H and $B^b$ to which trans-position can be effected according to the above in that the capacitor C19 in BO is increased by C65 or C66 in FL13 and FL14, respectively, of FIG. 3*b*. These capacitors are connected to circuit when the corresponding contact functions are closed in the series MT2–MT13, FIG. 3*a*. This proceeding is merely a transposition of the bass notes A, G, F, E and D included in the key C to the corresponding notes in the keys H and $B^b$.

The groups PG2–PG4 do not influence the tone frequency of BO in the preceding example relating to PG1, since the diodes D76–D78 are locked by the fact that the collectors in G4, G5 and G6, FIG. 3*b*, are at "earth potential" and via the diodes D80–D82 bring the mutually common potential connection points of PG2–PG4 to the same potential. The groups PG1–PG4 have mutually different basic bass melody patterns with the exception, however, that the "vertical" conductors from the ring-counter outputs P3/P7 and P5, respectively, are connected so as to render the third and the fifth, respectively, of all bass patterns. The remaining bass notes which are determined from the outputs P1, P2, P4, P6 and P8 can be freely disposed so that the bass melodies can be made mutually different which is of great importance from a musical point of view. The groups PG2–PG4 are arranged in the same manner as the groups PG1. If the group PG1 is assigned to the keys C, H and $B^b$ the group PG2 to the keys A, $A^b$, G, the group PG3 to the keys $G^b$, F, E and the group PG4 to the keys $E^b$, D, $D^b$ it can be seen that when playing a musical composition in, for instance, the key C in which the harmony functions tonica (C-chord) dominant (G-chord) sub-dominant (F-chord) and dominant—dominant (D-chord) are used — i.e. the elementary harmony functions—mutually different bass melodies are obtained for these harmony functions. The accompaniment will in this manner be rich in variation and living and gives the impression of a fully independent development or progress of the parts in correspondence to the bass accompaniment executed in a live orchestra.

The block designation 8 in FIG. 7 relates to the bass tone generator of the instrument. The bass tone is generated in the bass oscillator BO, FIG. 2*a*. In order to change the frequency the value of one bass resistance (R61 R86) is varied. The frequency change is also effected by the coupling in parallel of C19 with C65 or C66 according to the above. BO consists of an unstable multivibrator (AMV). The bass tone is frequency divided in BF1 and BF2.

The designation 9 in FIG. 7 relates to a gate stage for the bass tones and designated by PR in FIG. 2*a*. The FIG. shows on one hand a pulse stage which can be controlled directly by the pedal contacts in PD and on the other hand a switching stage PS intended to give to the bass tone signal entering through C27 and C28 the character of a decreasing amplitude as in a string, for instance. The pulse stage is used only at special occasions, for instance at unusual rhythm types. The contacts of the pedal PD are in such cases connected directly via N–NP. In the remaining cases there is an interruption between N and NP and the base of the transistor T25 is instead connected at Q to one of the pulse outputs F1–F3 of the rhythm pattern system according to FIG. 4 which will be more closely described hereinbelow.

The switching stage PS is provided at the collector of the transistor T25 with two diode oututs D13–D14 each connected to one RC-circuit, said RC-circuits having mutually different time constants. In the one case the RC-circuit consists of R55, C29 and C31. The capacitor C31 can be short-circuited by the contact OK3 whereby the time constants of the circuit are changed. In the other case the RC-circuit consists of R56 and C32. The first-mentioned RC-combination provides a slowly decreasing amplitude of the end portion of the bass note and the other RC-circuit provides a starting attack (tone start transient) These RC-combinations are connected via D11 and D12, respectively, to the variable resistance R53 between +A and "earth." After a predetermined period of decreasing amplitude the diodes are blocked successively. The capacitors C26a and C30 between the output BM and "earth" have only coupling and filter functions. At BM a filter known per se is connected which filter is arranged to provide a suitable overtone spectrum.

The reference numeral 10 in FIG. 7 relates to an amplifier which can be of conventional type. The block 10 also indicates a sound reproducing device for the bass and rhythm section.

The block 11 in FIG. 7 relates to pedal functions. These are designated by PD in FIG. 2*d*. The contacts referred to can, it is true, be adapted to be operated manually but they are preferably arranged to be operated by one of the player's feet as indicated. The pedal device comprises two (or more) mechanically suspended pedals PK and PT intended to be operated by the front part, toe contact, and the rear part, heel contact, of the foot. The unit can be operated by the heel only, PK, by the toe only, PT, or alternately. The movements are effected rhythmically wholly in accordance with the tempi and tempo variations desired by the player. If only the heel contact shall be used the sole should rest on a pedal, PT, for this purpose and the reverse is true when only the sole contact shall be used. The contact functions are so arranged that the points PU and PN are alternately connected to "earth" at pedal movements. The point N which is connected to the "earth" at every actuation is connected via R91 to the collector of a transistor T2 in a switching stage at the left in FIG. *2b* . At operation the collector receives a positive pulse, since C35 has been short-circuited for a short moment when N is connected (switched) to "earth". In resting or idle position N receives positive potential +A via R89. The positive pulse at the collector of T2 is passed via a small capacitor C36 to the base of a transistor T1 whose emitter is connected to the emitter of the one transistor T3 of the first of a number of multi-vibrators I-VIII which are mutually coupled in a manner such that they form together a known so called ring-counter ("Ringzähler") As to the function of the ring-counter reference is made to the literature: Schaltbeispiele, ITT, 1967, Ringzähler, page 43. Briefly explained the function of the ring-counter is to produce for each switching at one/and the same switching point the coupling into circuit of one and only one channel at a time in a group (ring) of channels and to automatically start a new series of couplings into circuit after all channels in the group has been coupled into circuit one after the other.

The contact means PK of the pedal device PD, FIG. *2d,* has an extra contact having the output NS which is connected to the part VIII of the ring-counter at the base of the transistor T18, FIG. *2b.* In this manner it will be possible for the player to interrupt a base melody which has been started and to immediately set the ring-counter to "zero" by connecting to "earth", the base in the second transistor of the last part VIII of the ring-counter so that the next actuation will always couple the first part I of the ring-counter into circuit. This function is best made possible mechanically in that the pedal PK is arranged so that it can be lifted an extra distance so that the extra or auxiliary contact co-operating with NS is closed. Since the base of T18, FIG. *2b,* is thereby connected to earth plus potential is obtained at P8 as a preparation for the next pedal operation, when part I of the ring-counter is coupled into circuit.

The ring-counter designated by 12 in FIG. 7 comprises the ring-counter parts or multivibrator stages I-VIII having outputs P1–P8. In each movement the state of one of these outputs is different from the state of the other outputs in such a manner that the +potential of this output is merely equal to +A, while the others have a potential of about +4V. This state is changed at every actuation of the ring-counter so that the output of the next ring-counter part receives the same state as the preceding part. Only the higher +potential is capable of influencing the functions connected to P1–P8.

The output signal from X and XI at the part I of the ring-counter has for its purpose to block and open, respectively, the diodes D7 and D8 of the device BO which is connected to the frequency dividers BF1 and BF2. If D7 is blocked the oscillator's BO own leading tone frequency will not be present at the output BU of the bass tone generator but the leading frequency from BF1 since D8 is always conducting when D7 is blocked, and vice versa. In this manner a bass note is obtained which is lower by one octave, when P1 has +potential which is desired for the bass pattern functions.

In FIG. 7 13 designates pulse generators for controlling the rhythm pattern circuit, described below, from the pedal device PD via the ring-counter I–VIII.

The block 14 in FIG. 7 relates to the rhythm pattern circuit which is more clearly shown in FIG. 4. At the bottom of this FIG. sixteen pulse generators in the form of transistor circuits having the transistors T26–T41 are shown. The transistor circuits form four mutually identical groups. These groups receive a drive potential in the form of pulse potential from the outputs P1, P2, P3 etc. of the ring-counter in a successive manner. Since only four groups exist (corresponding to a whole 4/4-bar) while the ring-counter has eight outputs (corresponding to two whole 4/4-bars) P1 and P5 are connected to produce +potential to the first pulse generator group, P2 and P6 connected to produce +potential to the second group etc. The +potential from the ring counter is coupled via diodes D110–D117 and the Zenerdiodes Z2–Z5. The latter has for purpose to block against the resting or idle potential at the outputs P1–P8, FIG. *2b,* which potential is not lower than +4V.The collectors of the transistors T26 –T41 which in idle position has +potential are each via one capacitor C39 –C54, respectively, connected to one "vertical" conductor in a rhythm pattern circuit M41 which also comprises a number, three in the shown embodiment of "horizontal" conductors, each connected to one terminal F1–F3. The horizontal conductors are via diodes D87 –D109 connected to vertical conductors according to special patterns for each of the horizontal conductors in correspondence to the rhythms to be produced by the rhythm circuit.

Each of the vertical conductors is connected to a resistance R100–R115 which by means of a resistance R170 is biased to about 2V.

When each of the transistors are successively brought to leading state a negative pulse occurs at the corresponding "vertical" conductor as counted from left to right for each 16th of a whole measure (bar) according to the note marking in FIG. 4. The vertical conductors' connection via diodes to the "horizontal" conductors can be effected according to other rhythm patterns than those according to FIG. 4 and the number of "horizontal" conductors can vary. The "horizontal" conductors receive pulse series which are mutually different and correspond to the desired rhythm types.

In FIG. 7 the reference numeral 15 relates to rhythm pattern selectors corresponding to the contacts OK-4–OK6 in FIG. 4. By means thereof pulses according to any of the rhythm patterns according to a predetermined program can be transmitted via the contacts F1–F3. In FIG. 7 the block 16 relates to a signal treatment stage generally designated "gate stage". In FIGS. 5 and 6 circuit diagrams for two such stages are shown. The device according to FIG. 5 is a switching device which is controlled from the terminals F1–F3 according to FIG. 4. The device has a connection Sil for an incoming signal and a connection Sul for an outgoing signal and is adapted to secure that the outgoing signal will have a desired dying-out amplitude. The circuit shown in FIG. 6 is a known resonant circuit which is adapted at the reception of a pulse from one of the connections F1–F3 to produce an oscillating output signal having a dying-out amplitude at the output Su2. Instead of or in addition to the circuits illustrated in FIGS. 5 and 6 other circuits can of course be connected for producing as accompaniment rhythmic sound effects, bass switching, rhythmic harmony support etc.

In FIG. 7 the blocks 17 and 18 represent a device for manual rhythm switching and a rhythm generator, respectively, which can be used as alternatives on occasions where the above described rhythm control shall not be used.

FIG. 9 shows the circuit diagram for an electronic circuit arranged to provide levelling of the time intervals between pulses or signals in a sequence of such pulses or signals generated by means of a pedal or manually.

In the following description of the pulse stage functions it is presumed that the pedal PT, FIG. 2*d*, is first in the lower position and the pedal PK is first in the upper position. In FIG. 9 the contact device proper is shown in simplified manner. PN receives "earth"-potential when the pedal PK is pressed down and PU is connected to earth when the pedal is lifted. At each actuation downwards and upwards, respectively, the state of FL15 is changed. A first actuation downward of PK renders in a 4/4-rhythm the first 16th in the first 4th and the first actuation upwards of PK is the 3rd 16th. The purpose of the circuit according to FIG. 9 is independently of tempo changes as accurately as possible to place the second 16th just between the first and the third 16th and the fourth 16th just between the third and fifth 16th.

At the actuation downwards of the pedal the following is happening, it being presumed that the part 1 of the ring-counter, FIG. 2*b*, is just about to be coupled into circuits. The ring-counter is switched by connecting N to "earth", which gives + (driving) potential or voltage at P1 which in turn delivers the potential to the interconnected bases of T26–T29 in the device according to FIG. 4. When this happens T26 becomes conducting directly, and the negative pulse occurring at its collector and thus at the horizontal conductors of the rhythm pattern system M41 which are coupled into circuit by a diode D87–D109 and a rhythm pattern selector OK-4–OK6 produces the first 16th in the sound reproducing device. At actuation downwards F115 in FIG. 9 changes its state. This means that T42 which was conducting before is blocked and the collector potential becomes almost equal to +A while the collector of T43 is set at "earth" potential. To each collector a RC-combination is connected, to T42 the combination R141, C55, R142 is connected and to T43 the combination R146, R56, R145. As to the values of the applied components it can be said that C55 is equal to C56 and that all resistors R141, R142, R145 and R146 are equal. The capacitor C56 which was charged before actuation downwards is now discharged through R145. At the same time as this discharge starts the re-charging of C55 via R141 starts. When the voltages over C55 and C66 are equal an equilibrium is attained in which the potential in the point of connection between the diodes D122 and D123 is minimum. The discharge of C56 which partly takes place through R145 passes initially also via D123 when D122 is blocked, but as soon as said equilibrium has been reached D123 is blocked and D122 starts conducting, now with the aid of the charging potential of C55. In the state of equilibrium the current through D122 and D123 and also the bass current to T44 and T46, respectively, has minimum value. This is so because the point of connection between D122 and D123 is connected via R148 and D125 or D126 to the base of the transistors T44 and T46. The base of T44 is, however, also connected to the collector of T42 via D124 and R140, and since the collector of T42 has +potential T44 is conducting and has low potential at the collector so that the Zener-diode Z6 is blocked. The base of T46 is coupled to the collector of T43 via D127 and R147. The collector is at "earth" potential. The base of T46 is therefore influenced by the potential from the point D122/D123 via R148. When the potential is at minimum, i.e. when the state of equilibrium exists, the collector of T46 has maximum potential and the Zenerdiode Z7 is chosen such that it opens at this maximum potential at the collector. The potential is transmitted via R155 to T47 which becomes conducting so that the relay Re4 is actuated. At the lifting of the pedal (to the position Pu) the same thing occurs but in the opposite sense with Z7 blocked and the relay Re3 operating. If the tempo is now increased, i.e. the speed between the positions PN and PU, the state of equilibrium is reached faster. The RC-combination R141, C55, R142 and R146, C56, C145, respectively, is chosen such that at the lowest existing tempo the charging and discharging of the condenser C55 is almost maximum. When the tempo is increased the potential over C55 and C56 will therefore not decrease to zero, but this is of no importance, since it is only the minimum value at the state of equilibrium which is of interest.

Thus, Re4 is actuated after actuation downwards of the pedal contact to PN so that the point RN is connected to "earth". According to FIG. 4 the point RN is connected to the emitter of the other transistor T27 which thus will become conducting and in the collector a negative pulse occurs which thus occurs also at the "vertical" conductor in the rhythm pattern M41 corresponding to the transistor T27. This pulse represents the second 16th and becomes perceptible in the sound reproducing device if the chosen rhythm pattern has a diode connection between this vertical conductor and the "horizontal"conductor corresponding to the rhythm pattern, which, however, is not the case in any of the examples of rhythm patterns shown in FIG. 4. At the lifting of the pedal according to FIG. 9 to PU T28 is connected to "earth" according to FIG. 4 and the pulse at the collector which thereby occurs constitutes the third 16th. A short moment thereafter Re3 according to FIG. 9 is actuated and the emitter of T29 is connected to "earth" via point RU, which is connected to "earth", and the pulse thereby occurring in the collector constituting the fourth 16th. At the next actuation downwards the ring-counter according to FIG. 2*a* changes over to P2 and the same process starts with the second group of four transistor circuits. According to FIG. 4, the first actuation downwards of the pedal giving the fifth 16th and the first actuation upwards renders the sixth 16th etc.

It is apparent from the above description that the circuit according to FIG. 9 secures that the beats which are to fall between beats corresponding to a downward and upward pedal movement always will fall just between the two latter beats. If a device according to FIG. 9 is not used the rhythm pulses would come irregularly, since it is often difficult for the player, especially if he is unskilled, to succeed in having the pulses corresponding to the lifting of a pedal contact to occur at the right moment, i.e. just between two adjacent pulses corresponding to a downward movement of the pedal, it being usually easier to get the latter pulses to occur at the right moments. However, it should be pointed out that the rhythm pattern system according to the invention can advantageously be used without any circuit according to FIG. 9 which latter should be regarded as the solution of a special problem. This problem exists also in other fields than electrical musical instruments when it is the question of producing a pulse series having even pulse intervals starting from a pulse series produced, for instance, manually and having or being liable to have uneven pulse intervals.

The invention is not limited to what has been shown in the drawings and to what has been described above since many modifications and variations can be effected by the artisan within the scope of the invention.

FIG. 8 shows a variation of the combination of resistance contact means shown in FIG. 2*c* which variation is used to vary certain bass notes upwards or downwards by a half degree. According to FIG. 8 four resistances and three contact means have been used to vary the third and the fifth of a bass note pattern.

Corresponding possibilities to alternative solutions of partial problems exist also in connection with other parts of the instrument according to the invention.

As to the practical realization of an instrument according to the invention it should be pointed out that this does not offer any difficulties to an expert in the electronic field, since only known standard elements need come to use. The harmony, bass and/or rhythm pattern circuits M1 - M41 can suitably be formed as so called printed circuits and these can, if desired, be arranged to be easily exchangeable for instance by the use of connectors of the plug-in type. Also other units can in a similar manner be made easily exchangeable or replaceable. In this manner various types of instruments having different desired prestanda can easily be produced and in addition thereto the maintenance work can be simplified and made less expensive.

LIST OF COMPONENT 0 12=IC-kretsar ITT/TCA 430
FD 12=IC-kretsar ITT/SAJ 110
D 1-D 201=1N4148
TR,Tr1,TR2=BC 168 B
Z1=BZY88/C5V6
Z2-Z5=BZY88/C9V1
Re1,Re2= Relä, 12V
R1=2.2 Kohm
R2=18 kohm
R3=100 Kohm
R4=1 Kohm
R5=1 Mohm
R6=220 kohm
R7a a, R7b=1 Mohm
R8a, a, R8b=33 Kohm-68 kohm
R9a, R9b, R9c=15 kohm
R10=220 kohm, trim
R11= 220 kohm, trim
R12=18 kohm
R13=100 kohm
R14=1 kohm
R15= 100 kohm
R16=3.3 kohm
R17=22 kohm
R18=3.3 kohm
R19=3.3 kohm
R20= 22 kohm
R21=22 kohm
R22=100 kohm
R23=100 kohm
R25=680 kohm
R=470 kohm
R27=500 kohm, trim
R28=680 kohm
R29=220 kohm
R30=500 kohm, trim
R31=100 kohm, trim
R32=100 kohm, trim
R33=120 kohm
R34=120 kohm
R35=120 kohm
R36=4.7 kohm
R34=15 kohm
R38=4.7 kohm
R39=2.2 kohm
R40=1 kohm
R41=2.2 kohm
R42=2.2 kohm
R43=1 kohm
R44=2.2 kohm
R45=22 kohm
R46=22 kohm
R47=22 kohm
R48=22 kohm
R49=22 kohm
R50=22 kohm
R51=22 kohm
R52=22 kohm
R53=220 kohm, trim
R54=220 kohm
R55=2.2 Mohm
R56=470 Kohm
R57=10 Kohm
R58=470 Kohm
R59=100 Kohm
R60=470 ohm
R61-R86=50 kohm, trim
87=10 kohm
R88=470 kohm
R89= 100 kohm
R90=5.6 kohm
R91=470 ohm
R92=680 ohm
R93=2.2 kohm
R94=2.2 kohm
R95=500 ohm, trim
R96=100 ohm, trim
R97=680 ohm, trim
R98=10 kohm
R99= =22 kohm
R100-R115=390 kohm
R116-R131=3.3 kohm
R132-R135=820 kohm
R136-R139=100 kohm
R140-R163=100 kohm
R164=470 kohm
R165=10 kohm
R166=1 Mohm
R167=220 kohm, trim
R168=100 kohm
R169=68 kohm
R170=47 kohm, trim
C1=0.047 μF
C2a=0.047 μF
C2b=0.047 μF
C3a=0.047 μF
C3b=0.047 μF
C3c=0.047 μF C4=0.047 μF
C5=10 μF, el. lyt
C6=0.1 μF
C10=0.047 μF
C11=6800 pF
C12=0.047 μF
C13=0.068 μF
C14=0.047 μF
C15=0.047 μF
C16=0.01 μF
C17=0.022 μF
C18=0.047 μF
C19=0.22 μF
C20=0.01 μF
C21=0.01 μF
C22-C25==0.01 μF
C26=0.01 μF
C26a=0.1 μF
C27=0.022 μF
C28=0.022 μF
C29=0.47 μF
C30=0.1 μF
C31=0.1 μF
C32=0.015 μF
C33=0.1 μF
C34=0.47 μF
C35=0.1 μF
C36=1000 pF
C36=220 pF
C38=0.01 μF
C39-C54=0.22 μF
C59=10 μF
C60=0.1 μF
C61=0.01 μF
C62=0.01 μF
C63=0.1 μF
C64=0.047 μF
C65=0.1 μF
C66=0.22 μF we claim:

1. A manually played electrical musical instrument comprising the combination of means for generating electrical signals corresponding to musical notes in a plurality of tonalities, members adapted to select signals from said signal generating means for reproducing corresponding notes in a sound reproducing apparatus, and a circuit adapted at repeated actuation of an electrical contact operable by the player to select from said signal generating means a sequence of notes in each tonality, said sequence comprising at least four notes including the fundamental, the fifth and the third and at least one additional note in the note scale corresponding to a predetermined tonality.

2. A musical instrument according to claim 1, in which said sequence comprises the fundamental, the fifth, the third, the second and the fourth of the scale of notes in the predetermined tonality.

3. A musical instrument according to claim 1, in which the fundamental, the third and the fifth are arranged to occur at the 1st, and the 3rd and the 5th, respectively, actuation of said contact in a series of eight contact actuations.

4. A musical instrument according to claim 1, in which manually operable members are arranged for changing at least one note in said sequence by a half degree in the tone scale corresponding to the predetermined tonality.

5. A manually played electrical musical instrument comprising a base note generator means for generating signals corresponding to musical bass notes, a bass note pattern circuit incorporated in a circuit arrangement for selecting a sequence of notes from said generator means, said bass pattern circuit comprising a first system of conductors, each connected to one of a predetermined number of inputs to said bass note generator means for defining a corresponding number of bass notes, and a second system of conductors connectable to conductors of the first system according to a predetermined system, a ring-counter comprising a number of flip-flop circuits controllable by the player being arranged to connect a number of conductors of said second system of conductors one after the other to corresponding conductors of said first system for initiating the corresponding bass notes of the bass note generator means.

6. A musical instrument according to claim 5; in which said first system of conductors is subdivided into a predetermined number of groups of conductors, each of the conductors of said second system of conductors being connectable to a conductor in each of the groups of conductors of said first system, bass tonality selectors operable by the player being provided to secure that only one optional group at a time of said groups is operating for controlling the bass note generator means.

7. A musical instrument according to claim 6, comprising a harmony note pattern system and harmony tonality selectors, said instrument further comprising a plurality of bass tonality selectors, said harmony tonality selectors and said bass tonality selectors being operable by the player by means of the same actuation members.

8. an electrical musical instrument comprising, in combination, means for generating electrical signals corresponding to musical notes in a plurality of tonalities, a plurality of manually operable means for simultaneously gating a plurality of signals derived from said signal generating means, harmony defining means responsive to the operation of each of said manually operable means to simultaneously select among the signals derived from said signal generating means a first signal, a second signal and a third signal, wherein the musical notes corresponding to said first, second and third signals together form a predetermined harmony in a predetermined tonality, the harmonies formed when operating all said manually operable means one after the other in said predetermined tonality constituting together a predetermined pattern of harmonies, at least five of which are mutually different, and transmission means for transmitting said selected signals to a device for reproducing musical notes.

9. A musical instrument according to claim 8, said harmony defining means being adapted to select among the signals derived from said signal generating means a fourth signal, the musical note corresponding to said fourth signal contributing to the harmony formed by the musical notes corresponding to said first, second and third signals.

10. A musical instrument according to claim 9, further comprising means operable by the operator to modify at least one note in at least one harmony of such a predetermined harmony pattern.

11. A musical instrument according to claim 9, in which said harmony defining means is adapted to direct said first, second, third and fourth signals to separate output channels for further transmission to said device for reproducing musical notes.

12. A musical instrument according to claim 8, further comprising means operable by an operator to modify at least one note in at least one harmony of such a predetermined harmony pattern.

13. A musical instrument according to claim 8, further comprising means operable by an operator to modify at least the third, the fifth and the sixth note in a scale of notes in each tonality by a chromatic degree.

14. A musical instrument according to claim 8, in which said harmony defining means is adapted to direct at least two of the selected signals to separate output channels for furher transmission to said device for reproducing notes.

15. A musical instrument according to claim 8, comprising a plurality of harmony defining electrical circuits, each circuit corresponding to one note within an octave of the chromatic scale of notes and comprising inputs from a first number of signal generators and outputs to a second number of groups of a third number of conductors, each harmony defining circuit being responsive to signals derived from said signal generators to select mutually different ones of said groups, the number of selected groups being equal to said third number.

16. A musical instrument according to claim 15, wherein each of the conductors in each of said groups of conductors is connected via a diode to one of a number, equal to said third number, of channels for further transmission to the device for reproducing musical notes.

17. A musical instrument according to claim 15, wherein diodes are connected between said signal generating means and each of said harmony defining circuits, said diodes being controlled by said manually operable means.

18. A musical instrument according to claim 15, further including tonality defining means, operable by an operator, for determining the composition of signals selected by said harmony defining circuits, so that the predominant portion of corresponding groups of signals from different harmonies within the pertaining tonality.

19. A musical instrument according to claim 15, further comprising a plurality of flip-flop circuits controllable by means operable by the operator, said flip-flop circuits enabling signal transmissions from the conductors of the selected groups of conductors to said transmission means.

* * * * *